US010214405B2

(12) United States Patent
Wagner

(10) Patent No.: US 10,214,405 B2
(45) Date of Patent: Feb. 26, 2019

(54) METHOD AND FILLING MACHINE FOR FILLING BOTTLES WITH A LIQUID FILLING MATERIAL

(71) Applicant: KHS GmbH, Dortmund (DE)

(72) Inventor: Friedhelm Wagner, Pfaffen-Schwabenheim (DE)

(73) Assignee: KHS GmbH, Dortmund (DE)

( * ) Notice: Subject to any disclaimer, the term of this patent is extended or adjusted under 35 U.S.C. 154(b) by 466 days.

(21) Appl. No.: 14/353,058

(22) PCT Filed: Oct. 12, 2012

(86) PCT No.: PCT/EP2012/004288
§ 371 (c)(1),
(2) Date: Apr. 21, 2014

(87) PCT Pub. No.: WO2013/056803
PCT Pub. Date: Apr. 25, 2013

(65) Prior Publication Data

US 2014/0283947 A1 Sep. 25, 2014

(30) Foreign Application Priority Data

Oct. 20, 2011 (DE) ..... 10 2011 116 469

(51) Int. Cl.

| | |
|---|---|
| ***B67C 3/06*** | (2006.01) |
| ***B67C 3/26*** | (2006.01) |
| ***B67C 3/10*** | (2006.01) |
| ***B67C 3/16*** | (2006.01) |

(52) U.S. Cl.
CPC ..... *B67C 3/06* (2013.01); *B67C 3/10* (2013.01); *B67C 3/16* (2013.01); *B67C 3/262* (2013.01); *B67C 3/2634* (2013.01); *B67C 2003/2602* (2013.01)

(58) Field of Classification Search
CPC .. B67C 3/06; B67C 3/262; B67C 3/16; B67C 3/10; B67C 2003/2602
USPC ..... 141/95, 46
See application file for complete search history.

(56) References Cited

U.S. PATENT DOCUMENTS 2,675,951 A * 4/1954 Oriol ..... B67C 3/16 141/149
2,794,453 A * 6/1957 Grosbois ..... B67C 3/06 141/147
2,808,856 A * 10/1957 Tiano ..... B67C 3/16 141/48

(Continued)

FOREIGN PATENT DOCUMENTS

DE 35 02 777 8/1985
DE 10 2007 020 625 11/2008

(Continued)

*Primary Examiner* — Jason K Niesz
*Assistant Examiner* — James Hakomaki
(74) *Attorney, Agent, or Firm* — Occhiuti & Rohlicek LLP

(57) ABSTRACT

A filling machine includes a filling element that has a liquid channel, a liquid valve, controlled gas paths, and a probe having a channel and an opening. The channel connects to a tank of filling material. A filter in a gas path traps contaminants. During filling, the liquid valve introduces filling material into a container, the first gas path connects to an interior space of the container, and the probe's position determines a fill level in the container.

20 Claims, 3 Drawing Sheets

(56) References Cited

U.S. PATENT DOCUMENTS 2,809,677 A * 10/1957 Hamner ..... B67C 3/16 137/595
2,905,363 A * 9/1959 Newey ..... B67C 3/04 141/117
4,390,048 A * 6/1983 Zelder ..... B04C 7/00 141/39
4,623,516 A * 11/1986 Weiler ..... B65B 3/022 137/241
4,989,650 A * 2/1991 Weiss ..... B67C 3/06 141/198
5,402,833 A * 4/1995 Clusserath ..... B67C 3/12 141/293
5,558,135 A * 9/1996 Kronseder ..... B67C 3/10 141/39
5,634,500 A * 6/1997 Clusserath ..... B67C 3/10 141/44
5,771,917 A * 6/1998 Carney ..... F15B 21/06 134/166 C
6,192,946 B1 * 2/2001 Clusserath ..... B67C 3/12 141/40
7,347,231 B2 * 3/2008 Schmoll ..... B67C 3/06 141/144
7,647,950 B2 * 1/2010 Clusserath ..... B67C 3/12 141/44
7,958,917 B2 * 6/2011 Conforti ..... B67C 3/10 141/198
2005/0241726 A1 * 11/2005 Clusserath ..... B67C 3/04 141/144
2009/0266439 A1 * 10/2009 Stolte ..... B08B 9/0813 141/6
2011/0197996 A1 * 8/2011 Clusserath ..... B67C 3/001 141/311 R

FOREIGN PATENT DOCUMENTS

| | | |
|---|---|---|
| DE | 10 2009 009 339 | 8/2010 |
| FR | 2 525 582 | 10/1983 |
| GB | 702 211 | 1/1954 |
| WO | WO2004/065283 | 8/2004 |
| WO | WO2010/000435 | 1/2010 |
| WO | WO2010/018850 | 2/2010 |
| WO | WO 2010115504 | * 10/2010 |

* cited by examiner

METHOD AND FILLING MACHINE FOR FILLING BOTTLES WITH A LIQUID FILLING MATERIAL

RELATED APPLICATIONS

This application claims is the national stage under § 371 of PCT/EP2012/004288, filed on Oct. 12, 2012, which claims the benefit of the Oct. 20, 2011 priority date of German application DE 102011116469.7, the contents of which are herein incorporated by reference.

FIELD OF INVENTION

The invention relates to filling containers, and in particular, to filling containers with the correct amount of liquid filling-material.

BACKGROUND

Two methods are known for setting a precise target fill level inside a container during filling. These are: the Trinox method and the vacuum filling method. Common to both methods is that a pipe-shaped probe is used on the filling element to determine fill level. The probe includes a gas-return pipe and extends into the container during the filling with at least one lower probe-opening. In both methods, the container is initially overfilled so that, during a filling phase, the lower probe-opening is submerged below the filling material level. After the filling phase, which ends with the closing of the liquid valve of the filling element, a fill-level correction phase begins. During this phase, overfilled filling material is removed from the container through the probe and returned to the filling-material tank.

In the Trinox method, to remove the overfilled filling material in the fill level correction phase, a sterile inert gas, for example CO2, at a pressure lying above the filling pressure or the pressure prevailing in the filling-material tank, is released into a headspace of the container. This pressure forces filling material through the probe back into the filling material tank until the probe opening is outside the filling material. At this point, the target fill level is reached. A disadvantage of the Trinox method, therefore, is the additional costs due to the inert gas.

In vacuum filling, which is mainly used in the filling of still products, i.e. for filling products that do not contain CO2, a negative pressure prevails in the filling-material tank. After closing the liquid valve, the container is removed from its sealed seat or sealed position on the filling valve so that, in the fill-level correction phase, the filling material is returned, by suction through the probe, into the filling-material tank due to the pressure difference between the pressure in the filling-material tank and the pressure of the ambient air until the probe opening is outside the filling material and thus the target fill level is reached.

A disadvantage of the vacuum filling method is that ambient air, and with it also possibly dirt, microorganisms, and pathogens, such as mold, and bacteria, inevitably enters the container's headspace and is thus placed into contact with the filling material.

SUMMARY

The invention includes a method with which an exact filling of containers without filling material losses or substantially without filling material losses and of optimum quality and/or at a reduced cost is possible with a high level of operational reliability.

As used herein, "container" includes cans and bottles, whether made of metal, glass, and/or plastic.

The phrase "container in a sealed position with the filling element" means that the container to be filled is pressed with its container mouth tight on the filling element or on a seal there, surrounding a discharge opening of the filling element.

As used herein, the term "headspace" means the space within the container interior under the container opening that is not taken up by the filling material.

As used herein, the terms "substantially" and "approximately" mean deviations from exact values in each case by +/−10%, and preferably by +/−5% and/or deviations in the form of changes not significant for functioning.

Further developments, benefits, and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

These and other features and advantages of the invention will be apparent from the following detailed description and the accompanying figures, in which.

DETAILED DESCRIPTION

Figure 1:
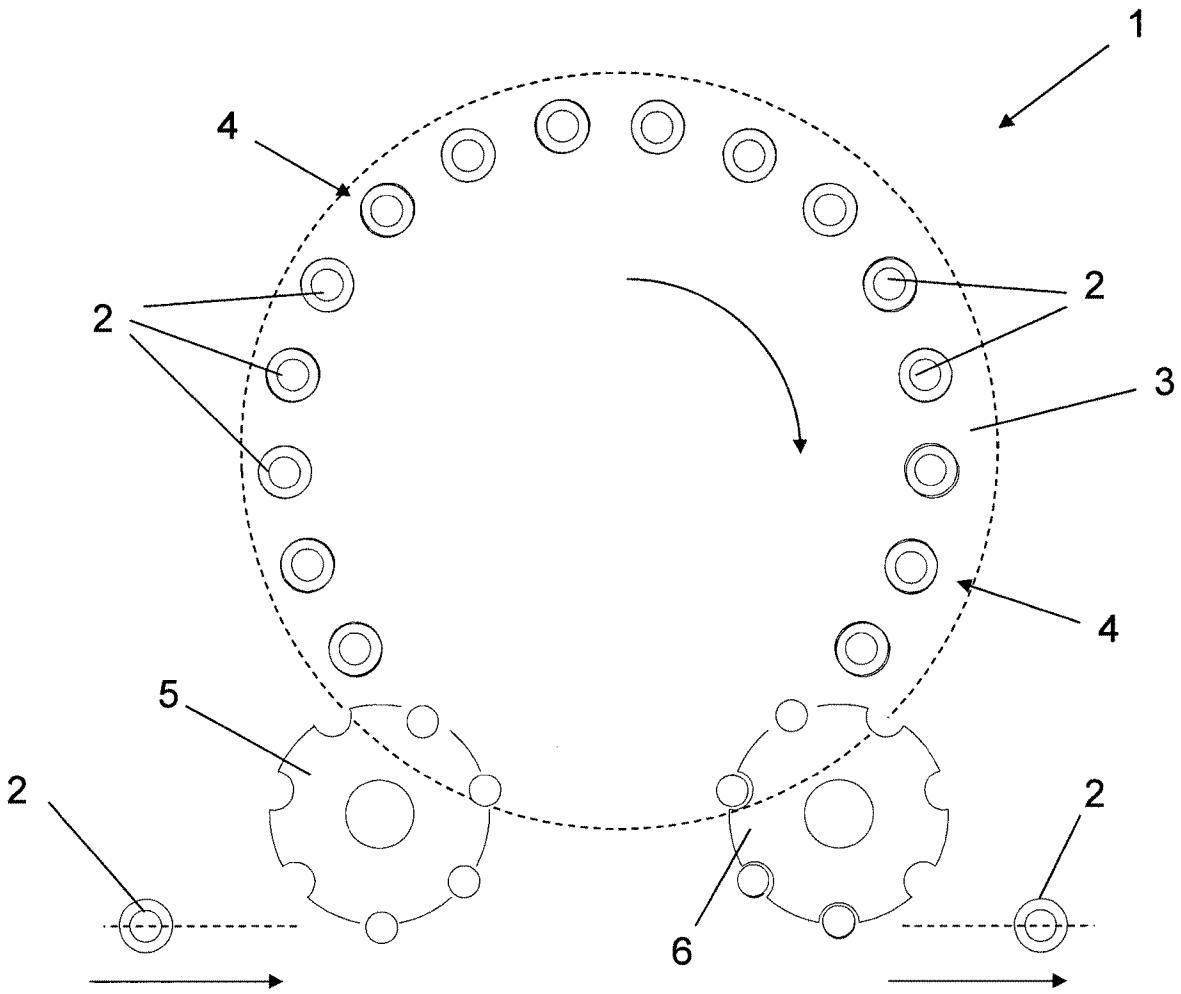
FIG. 1 is a simplified schematic representation in plan view of a filling machine according to the invention.

FIG. 1 shows a filling machine 1 that fills containers, such as bottles 2, with a liquid product or filling material. The filling machine 1 comprises a rotor 3 that can be driven to rotate around a vertical machine axis MA. On the circumference of the rotor are filling positions 4. A container inlet S individually supplies bottles 2 to be filled to the rotor 3 or to the filling positions 4. A container outlet 6 removes the filled bottles 2 from the rotor 3 or from the filling positions 4.

Figure 2:
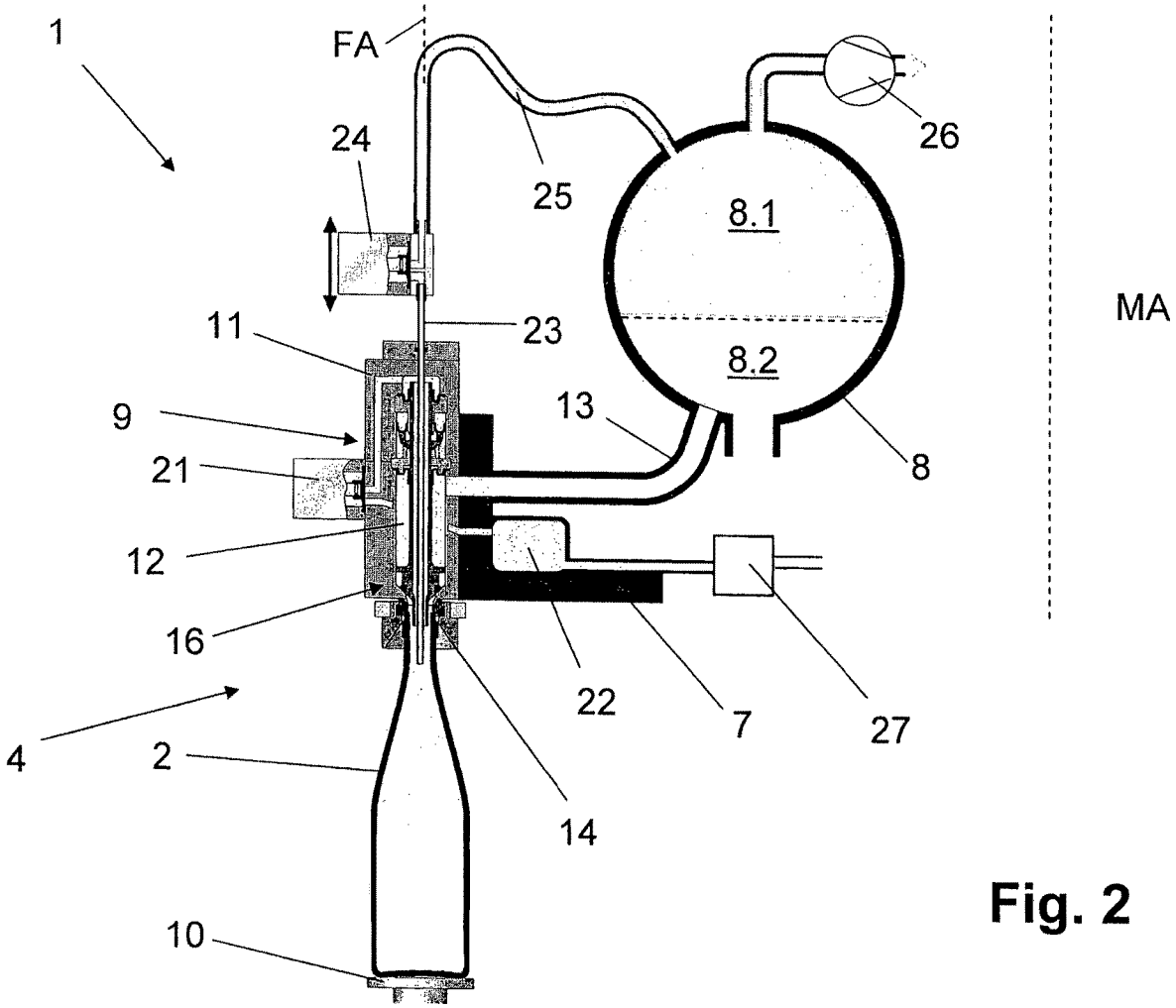
FIG. 2 is a simplified representation of one of the filling positions of the filling machine in FIG. 1.
Figure 3:
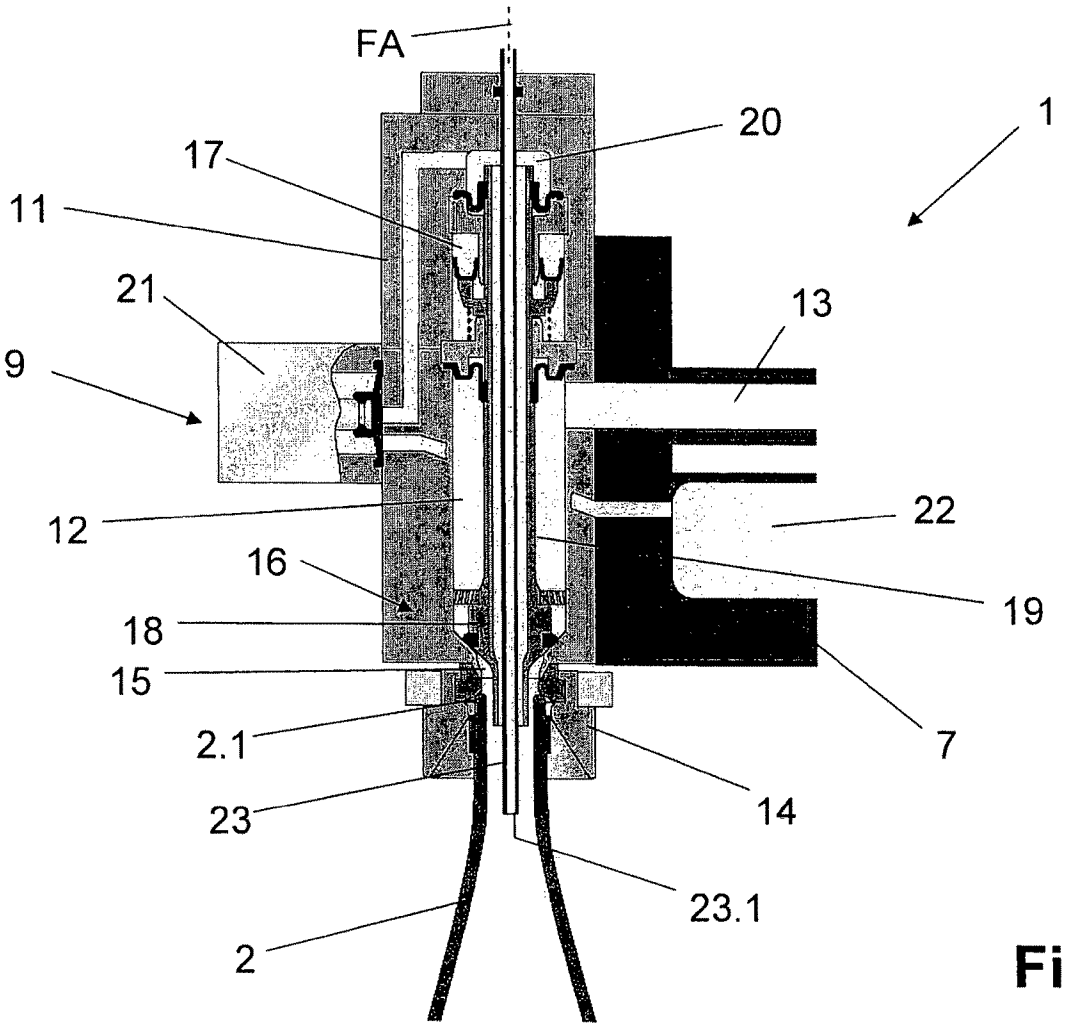
FIG. 3 shows the filling position of FIG. 2 in more detail.

FIG. 2 shows, in more detail, one of the filling positions 4 together with an annular top rotor element 7, concentrically enclosing the machine axis MA. On the rotor element 7 is an annular tank 8 that is common to all the filling positions 4 and that likewise concentrically encloses the machine axis MA. During the filling operation, liquid filling-material partially fills the annular tank 8 up to a filling-material level. Accordingly, the annular tank 8 is a "filling-material tank." The filling-material level divides the annular tank 8 into a gas space 8.1 above the filling-material level and a liquid space 8.2 below it. The liquid space 8.2 contains the liquid filling material.

Each filling position 4 has a filling element 9 and a container carrier 10 arranged below the filling element 9. In the illustrated embodiment, the container carrier 10 is a bottle plate that is coaxial with a vertical filling-element axis FA. The bottle plate is moveable upwards and downwards in a controlled manner in the direction of the filling-element axis FA. This movement raises and lowers a bottle 2 relative to the filling element 9.

A liquid channel 12 is formed within a housing 11 of the filling element 9. A product pipe 13 connects a top end of the liquid channel 12 to the liquid space 8.2 of the annular tank 8. On the underside of the filling element, in the area of a centering bell 14, a bottom end of the liquid channel 12 forms a discharge opening 15 through which liquid filling-material flows into a bottle 2 during the filling. Between the connection of the product pipe 13 and the discharge opening 15 is a liquid valve 16. An actuation device 17 opens and closes the liquid valve 16 in a controlled manner to control the filling of the particular bottle 2. An example of an actuation device 17 is a pneumatic cylinder.

The liquid valve 16 comprises a valve body 18 that is on a gas-return pipe 19 that acts as a valve plunger. The gas-return pipe 19 interacts with the actuation device 17 and opens with its top open end into a gas space 20. The gas space 20 is part of a controlled first gas path or first controlled gas path that is made in the housing 11 and that connects the gas-return pipe 19 to an annular channel 22 through a second control-valve 21. The latter is provided on the rotor element 7 jointly for all the filling positions 4 or filling elements 9 of the filling machine 1. The gas-return pipe 19, which is arranged on the same axis as the filling-element axis FA, projects with its lower open end beyond the underside of the filling element 9 so that it extends slightly into the headspace of the bottle 2, which, for filling, is pressed with an edge 2.1 of its opening by the container carrier 10 into a sealed position against the filling element 9 or against an annular seal enclosing the discharge opening.

Each filling element 9 comprises a height-adjustable probe 23 that can be moved in the direction of the filling-element axis FA. The height-adjustable probe 23 is formed by a length of pipe that is open at both ends, that is arranged on the same axis as the filling-element axis FA, and that extends through the gas-return pipe 19 and the gas space 20, which is sealed by the top face of the housing 11. The gas-return pipe 19 encloses the height-adjustable probe 23 but is at a distance from it so that it leaves a space. This resulting space forms an annular gas-return channel between the inner surface of an exhaust-gas pipe and the outer surface of the height-adjustable probe 23. This annular gas-return channel, which is open at both ends, opens into the gas space 20.

The height-adjustable probe 23 forms a probe channel, which is open at both ends. At its lower end, the probe channel has a lower probe-opening 23.1. The lower end extends beyond the discharge opening 15 and the lower end of the gas-return pipe 19. By adjusting the height of the height-adjustable probe 23, it is possible to adjust the bottle's target fill level.

The end of the height-adjustable probe 23 that projects above the top of the housing 11 is connected to a first control-valve 24, which is connected by a flexible pipe 25 to the gas space 8.1 of the annular tank 8, thus forming a controlled second gas-path or second controlled gas-path.

In the embodiment shown in FIG. 2, the filling machine 1 is made for a negative-pressure or vacuum filling method. In this method, the gas space 8.1 of the annular tank 8 is connected to a vacuum pump 26 so that a pressure below the ambient pressure prevails in the gas space 8.1 at least during the filling operation. The ring channel 22, which is common to all the filling positions 4, is connected to the environment by a filter unit 27, such as an air filter. The filter unit 27 reliably removes dirt, microorganisms, and pathogens, such as e.g. mold and bacteria, from the environment.

It is also possible to implement a vacuum method with the filling machine 1.

The vacuum method starts with the container carrier 10 raising a bottle 2 that has been transferred to a filling position 4 so that it lies with its mouth edge 2.1 in a sealed position against the filling element 9 and so that the probe 23 extends into the bottle by a length corresponding to the target fill-level. The first control-valve 24 is then opened to evacuate the bottle 2 and to equalize pressure between the inner space of the bottle 2 and the gas space 8.1 of the annular tank 8. Following this, with the first control-valve 24 still open, the liquid valve 16 is opened. This begins the filling phase.

During the filling phase, liquid filling-material flows through the discharge opening 15 into the inner space of the bottle 2 due to the height difference between the bottle 2 and the filling-material level in the annular tank 8. The discharge opening 15 is, moreover, preferably designed so that the filling material is fed in an umbrella-like pattern from the discharge opening 15 onto the inner wall of the bottle. The gas forced out of the interior of the bottle by the filling material exits through the probe 23 or its probe channel and by through the open first control-valve 24 into the gas space 8.1 of the annular tank 8.

The filling phase is ended by the closure of the liquid valve 16. This closing occurs by a corresponding control of the actuation device 17, for example by a timer. Other events can trigger closure of the liquid valve 16. For example, measuring signals from a flow-meter that measures the quantity of filling material that has flowed into the bottle can be used to close the liquid valve 16. In either case, the closing of the liquid valve 16 occurs when the level of the liquid filling-material in the bottle 2 is above the lower probe-opening 23.1 that is located at the bottom end of the probe 23.

After the end of the filling phase, which ends with the closure of the liquid valve 16, the fill level correction phase begins. With the first control-valve 24 still open, the second control-valve 21, which has, until now, been closed, is opened. As a result, the headspace of the bottle 2, which is still in a sealed position against the filling element 9, becomes connected to the environment by the gas-return pipe 19, the gas space 20, the open second control-valve 21, the ring channel 22, and the filter unit 27. Superfluous filling material is then sucked out of the headspace of the bottle 2 through the probe 23, until the lower probe-opening 23.1 emerges from the liquid filling-material. Once this occurs, the desired target fill-level in the bottle 2 will have been reached.

The first control-valve 24 is then closed, and with the second control-valve 21 still open, the headspace of the filled bottle 2 is depressurized to atmospheric or ambient pressure. After this depressurization, and after closing the second control-valve 21, the container carrier 10 lowers the filled bottle. The bottle 2 is then removed from the filling machine 1 through the container outlet 6.

The prescribed vacuum-filling method is suitable for both filling still drinks, such as wine and spirits, and also for filling drinks or wines containing a slight amount of CO2. In contrast to conventional vacuum filling systems or vacuum filling methods, the suction or return of the overfilled filling material from bottle 2 occurs while the bottle 2 is in a sealed position on the filling element 9. As a result, during the fill level correction phase, no unfiltered air enters the headspace of the bottle 2.

The filling machine 1 can also be used to implement a filling method based on the Trinox method. In this case, at the end of the filling phase, which is after the closing of the liquid valve 16, the fill-level correction phase begins. During this phase, filling material is forced out of the overfilled bottle 2 while it is in a sealed position against the filling element, or returned to the annular tank, through the probe 23 and the open first control-valve 24 until the lower probe-opening 23.1 is above the filling-material level in the bottle 2. This return is driven by subjecting the headspace of the bottle 2 to a pressurized and filtered pressure medium, such as gas and/or vapor, from the ring channel 22, into which pressure medium has been supplied through the filter unit 27. The pressure in the ring channel 22 is greater than the pressure in the gas space 8.1.

Examples of a suitable pressure medium include an inert gas, such as nitrogen, or, in the simplest case, filtered ambient air. If the pressure medium is ambient air, this air is preferably sucked up by a pump, which is not shown, compressed to a higher pressure, and filtered by at least one filter unit 27 on the way to the ring channel 22.

At the start of the filling process, the container carrier raises the bottle 2 so that the bottle 2 lies with its mouth edge 2.1 in a sealed position against the filling element 9 and so that the probe 23 extends into the bottle by a length corresponding to the target fill level. The first control-valve 24 is then opened to evacuate the bottle 2. When necessary, pressure between the inside of the bottle 2 and the gas space 8.1 of the annular tank 8 is equalized. Following this, with the first control-valve 24 still open, the filling phase begins with the opening of the liquid valve 16.

Upon opening the liquid valve 16, liquid filling-material flows through the discharge opening 15 into the inner space of the bottle 2. It does so as a result of a height difference between the bottle 2 and the filling material level in the annular tank 8. The discharge opening 15 is preferably designed so that the filling material flows in an umbrella-like pattern from the discharge opening 15 onto the inner wall of the bottle. The gas forced out of the inner space of the bottle by the filling material exits through the probe 23 or its probe channel, through the open first control-valve 24, and on into the gas space 8.1 of the annular tank 8.

The filling phase ends when the actuation device 17 closes the liquid valve 16. The actuation device 17 does so in response to lapse of a timer. However, other events can trigger closure. For example, measuring signals from a flow-meter that captures the quantity of filling material flowing into bottle 2 can be used to close the liquid valve 16. In either case, the liquid valve 16 closes when the level of the liquid filling-material in the bottle 2 is above the lower probe-opening 23.1 at the bottom end of the probe 23.

In the fill level correction phase, which then follows by opening the second control-valve 21, the headspace of the bottle 2 is subjected to the pressure of the filtered pressure medium from the ring channel 22. This causes the liquid filling-material from the overfilled bottle 2 to be returned by the probe 23 and through the open first control-valve 24 into the annular tank 8 until the desired target fill level is reached and the lower probe-opening 23.1 is above the filling material level in the bottle 2.

After this, and after the closing of the second control-valve 21, the filled bottle 2 depressurizes through the probe 23 and the open first control-valve 24 to the ambient pressure prevailing in the gas space 8.1. After depressurization, the container carrier 10 lowers the filled bottle 2 from the filling element 9. The bottle is then removed from the filling machine 1 by the container outlet 6. When this filling method based on the Trinox method is used, the vacuum pump 26 is not necessary.

The invention was described above using examples of embodiments. It is clear that modifications and variations are possible without thereby departing from the inventive idea underlying the invention.

Having described the invention, and a preferred embodiment thereof, what is claimed as new, and secured by Letters Patent is:

1. A method for filling a container with a liquid filling-material that is obtained from an annular tank, said method comprising using a filling system that comprises a filling element, a liquid valve, and a probe, wherein said container is held tightly against said filling element during filling, wherein said liquid valve is configured for controlled introduction of said liquid filling-material into said container, wherein, during filling, said probe extends into said container, wherein said probe comprises a probe opening that leads into a probe channel, and wherein said probe opening is used in connection with determining a fill level, said method comprising using said filling system to execute a filling phase, and using said filling system to execute a fill-level correction phase, wherein using said filling system to execute said filling phase comprises overfilling said container, wherein using said filling system to execute said fill-level correction phase comprises removing a quantity of liquid filling-material from said container,—said quantity being selected to cause a level of filling material level in said container to reach a target level, wherein overfilling said container comprises controlling said liquid valve so as to cause said filling material level in said container to rise above said probe opening, wherein removing said quantity comprises returning said quantity to said annular tank, wherein returning said quantity comprises causing said quantity to pass through said probe opening and to flow through said probe channel toward said annular tank until the level of said liquid filling-material falls below said probe, wherein causing said quantity of liquid filling-material to pass through said probe opening and causing said quantity of liquid filling-material to flow through said probe channel toward said annular tank until said probe opening is outside said liquid filling-material comprises selecting and using a method from the group consisting of a suction method and an overpressure method, wherein said suction method comprises using said probe to suck said liquid filling-material from said container while simultaneously venting a headspace of said container by supplying said headspace with air, wherein said air is filtered ambient air, and wherein said overpressure method comprises subjecting a headspace of said container to an overpressure resulting from air, wherein said air is filtered ambient air.

2. The method of claim 1, wherein selecting and using a method from the group consisting of a suction method and an overpressure method comprises selecting and using said suction method, and, after having overfilled said container, venting said headspace through a controlled gas path having a filter unit.

3. The method of claim 2, wherein venting said headspace of said container comprises passing gas through a gas return channel of a return gas pipe, wherein said gas return channel is separate from said probe channel, wherein said return gas pipe forms part of a controlled first gas path of said filling element.

4. The method of claim 3, wherein said probe channel that connects said probe opening to a gas space in said filling material tank through a controlled valve, said method further comprising opening said controlled valve, thus establishing a connection between said probe opening and said gas space prior to said filling phase, thereby equalizing a pressure in an interior space of the container and a pressure in said filling material tank, and keeping said controlled second gas path open during said filling phase.

5. The method of claim 3, further comprising, prior to said filling phase, while said container is arranged against said filling element, opening a first control valve to evacuate said container and, during said filling phase, allowing gas forced out of said container by said filling material to exit through said probe channel, through said first control valve, and into a gas space in said annular tank.

6. The method of claim 4, wherein using said filling system to execute said fill-level correction phase comprises having said first and second controlled gas paths open at the same time.

7. The method of claim 1, further comprising, prior to using said filling system to execute said filling phase, achieving pressure equalization between an interior space of said container and a gas space formed above a level of liquid-filling material in said annular tank, wherein achieving pressure equalization comprises connecting an interior space of said container to said gas space.

8. The method of claim 1, wherein said suction method further comprises causing a gas space in said annular tank to be at a pressure below ambient pressure during filling.

9. The method of claim 1, wherein using said filling system to execute said filling phase comprises opening a first control valve, evacuating said container, equalizing pressure between an inner space of said container and said gas space, and, with said first control valve remaining open, opening said liquid valve, thereby permitting liquid-filling material to flow along an inner wall of said container as a result of a height difference between said container and a filling-material level in said annular tank.

10. The method of claim 9, wherein using said filling system to execute said fill-level correction phase comprises, with said first control valve remaining open, opening a second control valve, and connecting a headspace of said container with said air, and allowing superfluous filling material to be sucked out of said headspace and returned to said annular tank.

11. The method of claim 10, wherein using said filling system to execute said fill-level correction phase further comprises, after having allowed said superfluous filling material to be sucked out, closing said first control valve while leaving said second control valve open, depressurizing said container, and, after said container has been depressurized closing said second control valve.

12. The method of claim 10, wherein using said filling system to execute said fill-level correction phase comprises depressurizing said filled container through said probe and said first control valve to ambient pressure prevailing in said gas space.

13. The method of claim 1, wherein using said filling system to execute said fill-level correction phase comprises closing said liquid valve in response to a signal that measures a quantity of filling material that has flowed into said container.

14. The method of claim 1, wherein using said filling system to execute said fill-level correction phase comprises closing said liquid valve when a level of liquid filling-material in said container is above said probe opening.

15. An apparatus for filling a container with liquid filling-material, said apparatus comprising a filling machine, said filling machine comprising a first filling position and an annular tank having a liquid space and a gas space above said liquid space, wherein said first filling position comprises a filling element and a container carrier, wherein said filling element comprises a liquid channel connected to said annular tank, a liquid valve disposed to control flow in said liquid channel, a controlled first gas path that connects to an interior space of said container, a filter unit disposed in said controlled first gas path to trap contaminants in air that is supplied to said controlled first gas path, and a probe configured for determining a fill level in said container, said probe comprising a probe channel that passes through said probe and a probe opening in a bottom end of said probe channel, wherein said probe channel connects to a gas space of an annular tank via a first control valve, and wherein, during a filling phase, controlled opening and closing of said liquid valve introduces filling material into a container that is disposed in a sealed position against said filling element.

16. The apparatus of claim 15, further comprising a vacuum pump, wherein said gas space of said annular tank is connected to said vacuum pump.

17. The apparatus of claim 15, wherein said filter unit connects said controlled first gas path to a source for said air.

18. The apparatus of claim 15, further comprising a rotating transport element that rotates about a vertical machine axis, wherein a plurality of said filling positions is disposed along a periphery of said rotor, wherein controlled first and second gas paths of each filling element are separately controllable, wherein said controlled first gas path has a channel that is common to all of said filling elements, wherein said channel is connected to said filter unit.

19. The apparatus of claim 15, wherein said filter unit directly connects said controlled first gas path to a source for said air.

20. The apparatus of claim 15, wherein said filter unit connects said controlled first gas path to a source for said air in a manner such that there is no reducing valve between said filter unit and said source.

* * * * *